US006909401B2

(12) United States Patent
Rutfors et al.

(10) Patent No.: US 6,909,401 B2
(45) Date of Patent: Jun. 21, 2005

(54) ANTENNA DEVICE

(75) Inventors: Tomas Rutfors, Sollentuna (SE); Christian Braun, Stockholm (SE); Henrik Falken, Lidingo (SE); Lennart Håkansson, Brottby (SE); Liu Donghui, Taby (SE); Anders Thornell-Pers, Åkersberga (SE)

(73) Assignee: AMC Centurion AB, Akersberga (SE)

( * ) Notice: Subject to any disclaimer, the term of this patent is extended or adjusted under 35 U.S.C. 154(b) by 0 days.

(21) Appl. No.: 10/312,565

(22) PCT Filed: Jul. 10, 2001

(86) PCT No.: PCT/SE01/01600

§ 371 (c)(1),
(2), (4) Date: Feb. 25, 2003

(87) PCT Pub. No.: WO02/05380

PCT Pub. Date: Jan. 17, 2002

(65) Prior Publication Data

US 2003/0189519 A1 Oct. 9, 2003

(30) Foreign Application Priority Data

Jul. 10, 2000 (SE) ..... 0002599
Dec. 20, 2000 (SE) ..... 0004724

(51) Int. Cl.[7] ..... H01Q 1/24; H01Q 7/00; H01Q 1/38

(52) U.S. Cl. ..... 343/702; 343/700 MS; 343/866

(58) Field of Search ..... 343/702, 700 MS, 343/793, 893, 721, 765, 827, 866, 726, 727; 455/341

(56) References Cited

U.S. PATENT DOCUMENTS

| | | | | |
|---|---|---|---|---|
| 4,260,990 A | * | 4/1981 | Lichtblau | 343/742 |
| 4,903,326 A | * | 2/1990 | Zakman et al. | 455/575.7 |
| 5,300,936 A | * | 4/1994 | Izadian | 343/700 MS |
| 5,465,099 A | * | 11/1995 | Mitsui et al. | 343/730 |
| 5,760,747 A | | 6/1998 | McCoy et al. | 343/728 |

FOREIGN PATENT DOCUMENTS

| | | | |
|---|---|---|---|
| EP | 0817312 A2 | 1/1998 | H01Q/21/28 |
| EP | 0945917 A2 | 9/1999 | H01Q/21/28 |
| WO | WO90/13152 | 11/1990 | H01Q/1/24 |

* cited by examiner

*Primary Examiner*—Don Wang
*Assistant Examiner*—Trinh Vo Dlnh
(74) *Attorney, Agent, or Firm*—Jacobson Holman PLLC

(57) ABSTRACT

An antenna device for a radio communication device, preferably a portable radio communication device, comprising a first antenna element (20) comprising a first feeding portion (22) connected to a first feeding device (24), a second antenna element (30; 230; 330; 430; 530; 630) comprising second feeding portions (32, 33; 332, 333) connected to a second feeding device (34), wherein said first antenna element (20) has an unbalanced feed, and said second antenna element (30; 230; 330; 430; 530; 630) has an essentially balanced feed.

18 Claims, 5 Drawing Sheets

ANTENNA DEVICE

This is a nationalization of PCT/SE01/01600 filed Jul. 10, 2001 and published in English.

FIELD OF INVENTION

The present invention relates generally to antenna devices and more particularly to an antenna device for use in a radio communication device, such as a mobile phone.

BACKGROUND

In a portable radio communication device the space for an internal antenna arrangement is limited. With the growing need for greater functionality and better radio channel quality it is often necessary to utilise more than one antenna element in a portable radio communication device, such as a mobile telephone. Because of the limited space in a portable radio communication device, internal antennas tend to be closely spaced. With closely spaced antenna elements unwanted coupling between the antennas can arise.

Low coupling between closely spaced antennas is necessary for various applications. These can be for example: separate RX and TX antenna system which eliminates the need for a diplexer, antenna diversity systems (both receiver and transmitter diversity), antennas for different systems (e.g. GSM-Bluetooth).

In WO 9013152 is described the case of separated RX/TX antennas. WO 9013152 mentions only the case of two antennas of the same type (two similar patches). In WO 9013152 a solution for eliminating the need for a diplexer is provided. Further, it is disclosed that separated transmit and receive antennas are elevated above a grounding surface by a conductive pedestal, wherein the pedestal is placed between the antennas and electrically isolates the antennas.

The above-described document only describes reduced coupling between separated transmit and receive antennas.

SUMMARY OF THE INVENTION

An object of the present invention is to provide an antenna device for use in a radio communication device, preferably a portable radio communication device, wherein the electrical coupling between transmit and receive antenna elements is minimised.

The invention is based on the realisation that when one antenna element has a balanced feed and another antenna element has an unbalanced feed, it is possible to design the two antennas in a way in which the coupling between the antennas can be lower than with two antennas both having unbalanced or balanced feed.

An advantage with a balanced and unbalanced antenna pair is that with a balanced input to receiver electronic circuits and an unbalanced feeding from an output amplifier, lower losses and improved matching to the receiver/transmitter are achieved.

According to the present invention there is provided an antenna device as defined in appended claim 1.

There is also provided a radio communication device comprising such an antenna device.

Further preferred embodiments are defined in the dependent claims.

BRIEF DESCRIPTION OF DRAWINGS

The invention is now described, by way of example, with reference to the accompanying drawings, in which.

DETAILED DESCRIPTION OF THE INVENTION

Figure 1:
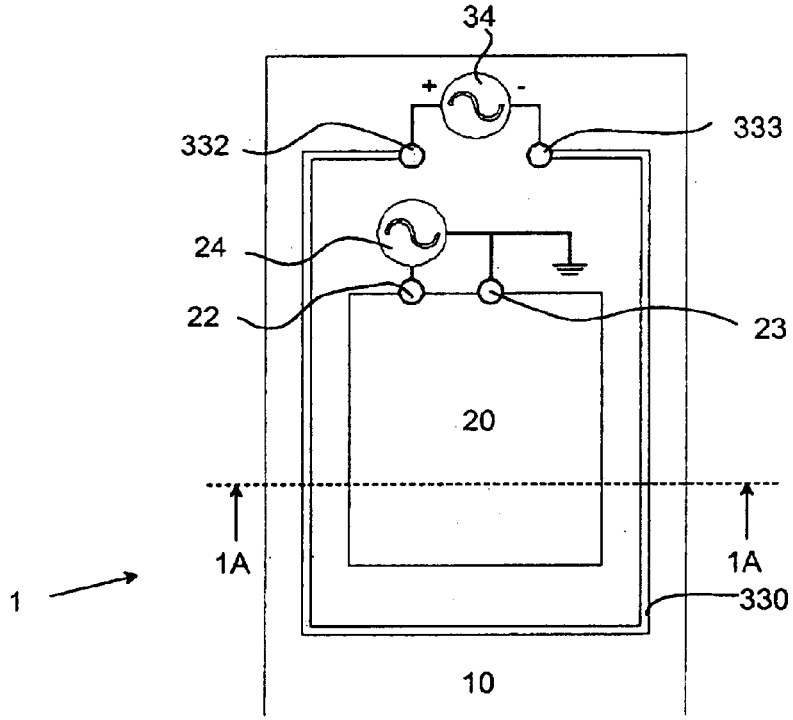
FIG. 1 is a schematic to view of a first embodiment of an antenna device according to the invention.

In the following, a detailed description of preferred embodiments of an antenna device according to the invention will be given. In the several embodiments described herein, the same reference numerals are given to identical parts of the different embodiments.

A balanced feed is defined as when a transmission line, comprising two conductors in the presence of ground, is capable of being operated in such a way that when voltages of the two conductors at all transverse planes are equal in magnitude and opposite in polarity with respect to ground, currents in the two conductors are essentially equal in magnitude and opposite in direction. An unbalanced feed is defined as a feed that does not fulfil the above criteria.

Reference is first made to FIG. 1, wherein an antenna device or module, generally designated 1, comprises a printed circuit board (PCB) 10, having mounted thereon circuits for the transmitter portion 24 and the receiver portion 34 of the electronic circuitry of a mobile phone (not shown in the figures). The PCB 10 also functions as a ground plane for a Planar Inverted F Antenna (PIFA), the radiating element of which is designated 20. The radiating element 20 is positioned spaced apart from the PCB 10 and essentially parallel thereto and comprises a feeding portion 22 connected to a feed element of the transmitter portion 24 and a grounding portion 23 connected to a ground element of the transmitter portion. Thus, the PIFA 20 functions as a transmitting antenna of the device 1.

The PIFA 20 is an unbalanced fed electric antenna where the grounding portion 23 is connected directly to ground. The connection may alternatively be via a matching network comprising lumped or distributed inductors and/or capacitors.

The antenna device 1 also comprises a loop antenna designated 330. The loop antenna is made of a conducting wire forming a loop in a plane parallel to the PCB 10 and also to the radiating element 20 and essentially in the plane of the PIFA element, surrounding the PIFA element.

The coupling between the PIFA antenna 20 and the balanced fed loop antenna 330 is low because the PIFA 20 gives an essentially electric field perpendicular to the antenna plane and the balanced fed loop antenna 330 gives an essentially magnetic field with direction perpendicular to the antenna plane. Therefore the antennas have a low coupling between each other.

The loop antenna 330 is connected by its ends 332, 333 to a respective input of the receiver portion 34. In the figure, one input is labelled as positive and the other as negative. The loop antenna 330 is balanced, i.e. it is fed by opposing signals, whereby it functions as a magnetic antenna.

Alternatively the loop antenna 330 could be replaced with an open loop, i.e. a dipole antenna.

Figure 7:
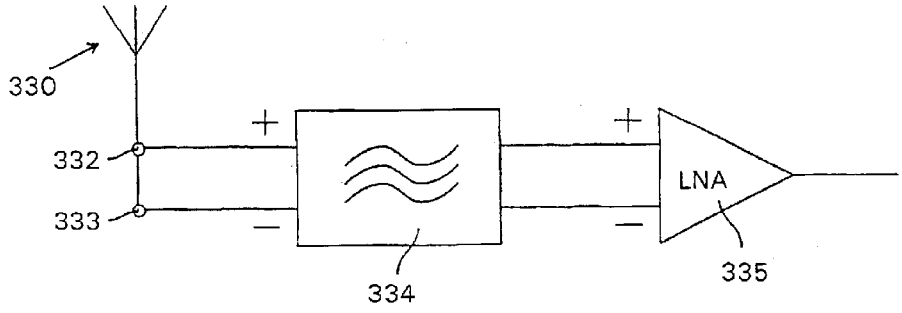
FIG. 7 is a block diagram showing a preferred layout of the receiving RF chain of an antenna device according to the invention.

A preferred layout of the receiving RF chain of the receiver portion 34 will now be described with reference to FIG. 7. The RF chain comprises a balanced filter 334, the inputs of which, labelled "+" and "−" in the figure, are connected to the receiving antenna 330 by its ends 332, 333. The outputs of the balanced filter 334 are connected to a low noise amplifier (LNA) 335 having a balanced input, labelled "+" and "−". The LNA 335 is in turn connected to RF electronics (not shown) of the receiver portion 34. This connection can be balanced or unbalanced.

The provision of a balanced filter 334 gives the following advantages. Firstly, the balun found in conventional arrangements for converting the received signal from unbalanced to balanced is omitted, thereby decreasing signal losses, manufacturing costs and the space required by the RF electronics. Secondly, the isolation between the transmitter and receiver circuits is increased because the transmitter chain is unbalanced and the receiver chain is balanced. This results in less crosstalk between the circuits.

Yet another advantage of having a balanced LNA is that it can then be made by Application Specific IC (ASIC) technology, which is preferred. ASIC applications are always balanced.

A preferred layout of the transmitting RF chain of the transmitter portion 24 will now be described with reference to FIG. 8. The TX chain comprises a balanced power amplifier (PA) 25 having an input connected to the transmitter electronics (not shown). This input can be balanced or unbalanced. The balanced output of the amplifier is connected to the input of a balanced filter 26, the output of which feeds the transmitter antenna.

The advantage of providing the transmitter chain in this way is the decreased coupling between the transmitting and receiving circuits, resulting in less crosstalk etc.

Figure 2:
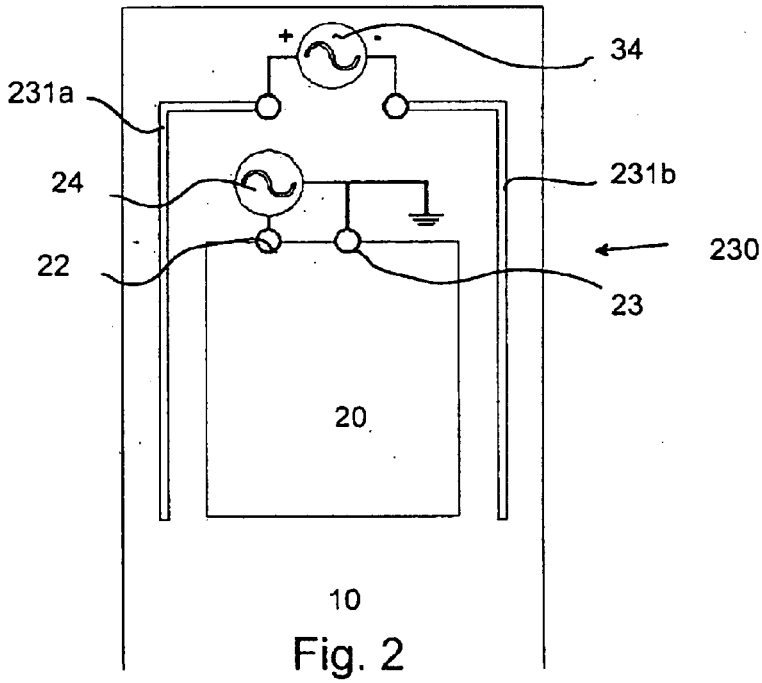
FIG. 2 is a schematic top view of a second embodiment of an antenna device according to the invention.
Figure 1A:
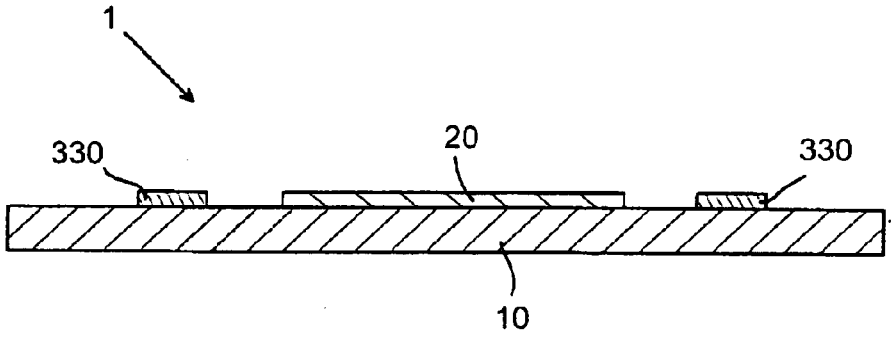
FIG. 1A is an elevated sectional view of the first embodiment of an antenna device according to the invention taken along lines 1A—1A of FIG. 1.

In an alternative second embodiment shown in FIG. 2, the loop antenna has been replaced by a dipole antenna 230 comprising two strand like portions 231*a*, 231*b*. These portions surround the PIFA element 20 on either side thereof and in level with the essentially planar element 20. As in the first embodiment, the dipole antenna 230 has a balanced feed portion.

The two strand like portions 231*a* and 231*b* are shown as two portions of equal length, but preferably the length of one of the elements, e.g. 231*b*, is adapted to adjust the impedance and/or the resonance frequency of the dipole antenna 230.

Figure 3:
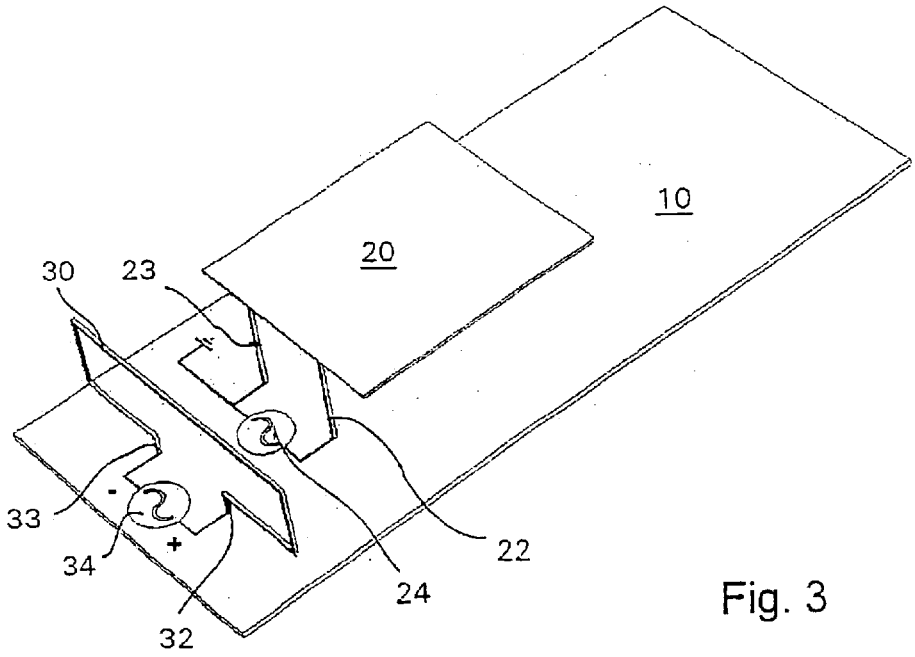
FIG. 3 is a schematic top view of a third embodiment of an antenna device according to the invention.

In an alternative third embodiment shown in FIG. 3, the receiving antenna is a loop antenna 30 with its ends 32, 33 connected to respective input of the receiver portion. However, in contrast to the embodiment described hereinabove with reference to FIG. 1, this loop antenna is provided in a plane perpendicular to the PCB 10 and the PIFA element 20.

The three embodiments shown in FIGS. 1–3 are all basic configurations of the antenna device according to the invention. They all have in common that there is provided an unbalanced PIFA antenna functioning as a transmitting antenna and a balanced fed receiving antenna, which is either a loop or dipole antenna. In FIGS. 1 and 2 the balanced fed antenna 330, 230 further surrounds the PIFA antenna 20.

Figure 4:
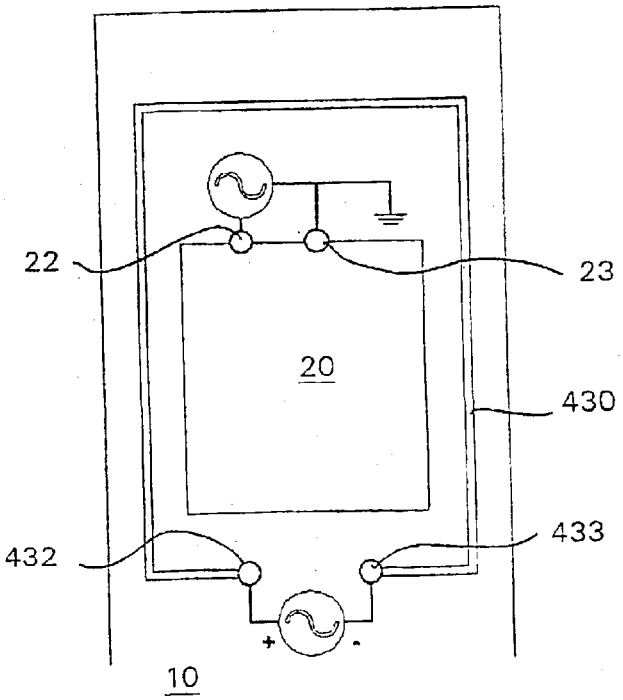
FIG. 4 is a schematic top view of a fourth embodiment of an antenna device according to the invention.
Figure 5:
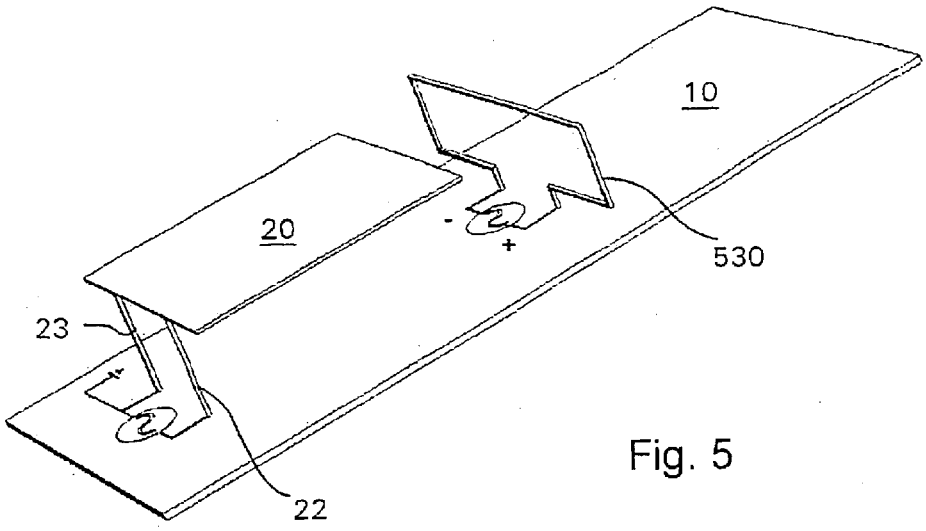
FIG. 5 is a schematic perspective view of a fifth embodiment of an antenna device according to the invention.
Figure 6:
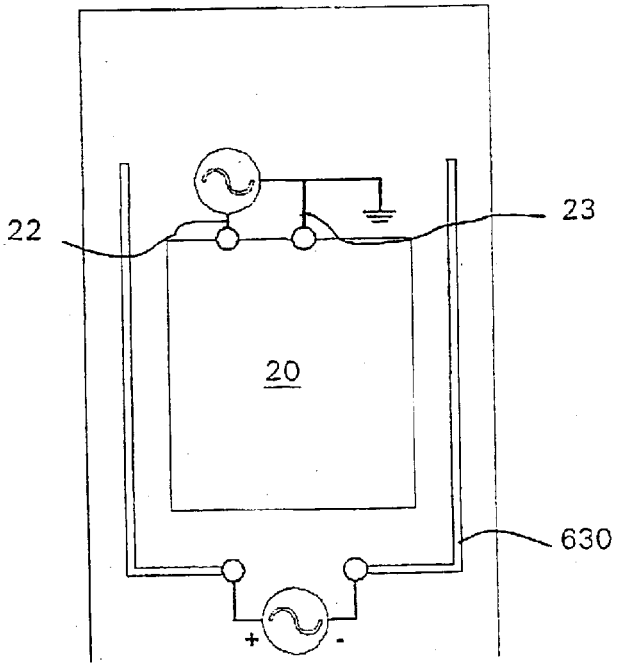
FIG. 6 is a schematic top view of a sixth embodiment of an antenna device according to the invention.

In FIGS. 4–6, variants of the basic configurations are shown. The embodiment shown in FIG. 4 is similar to the one of FIG. 1 but with the difference that the connections 432, 433 to the loop antenna 430 are made on a side of the PIFA element 20 opposite of the feeding and grounding portions 22, 23 of the PIFA. This provides the advantage that the coupling to the PCB is affected and may be adapted to a desired design.

The embodiment shown in FIG. 5 is similar to the one of FIG. 3 but with the difference that the loop antenna 530 is provided on a side of the PIFA element 20 opposite of the feeding and grounding portions 22, 23 of the PIFA. This provides the advantage that the coupling to the PCB is affected and may be adapted to a desired design.

The embodiment shown in FIG. 6 is similar to the one of FIG. 2 but with the difference that the connection portions of the dipole antenna 630 are provided on a side of the PIFA element 20 opposite of the feeding and grounding portions 22, 23 of the PIFA. This provides the advantage that the coupling to the PCB is affected and may be adapted to a desired design.

In order to minimise coupling between the unbalanced and balanced antenna, the unbalanced antenna is preferably miniaturised. By loading the unbalanced antenna with a high dielectric material, such as ceramic or a mixture of ceramic and plastic, the minimum distance between the unbalanced and balanced antenna is increased, whereby the coupling there between is further reduced.

Preferred embodiments of an antenna device according to the invention have been described. However, the person skilled in the art realises that these can be varied within the scope of the appended claims without departing from the inventive idea. Thus, although a transmitting and a receiving antenna have been shown, the inventive idea is not limited to that. As an example, two receiving antennas could be provided, wherein one is balanced and the other is unbalanced. In that way, the coupling there between is minimised. Also, antenna diversity is obtained. The different antennas could be operating for different communication systems, e.g. Bluetooth, GSM, and UMTS. They could also be operating at different bands, e.g. GSM900 and GSM1800. There could also be provided further combinations such that the possible combinations are: two transmitting/receiving antennas; a transmitting/receiving antenna and a receiving antenna; a transmitting/receiving antenna and a transmitting antenna; two receiving antennas; two transmitting antennas; a transmitting antenna and a receiving antenna; wherein each combination each antenna could be unbalanced or balanced.

Specific antenna patterns have been shown. However, the person skilled in the art realises that the unbalanced antenna is not necessarily a PIFA, but can be e.g. a patch, modified PIFA, meander PIFA, or slot.

In the figures feeding devices 24, 34 have been illustrated, which should be interpreted as: a feed device for a transmitting antenna, a receiver device for a receiving antenna, and a feed/receiver device for a transmitting/receiving antenna.

Figure 8:
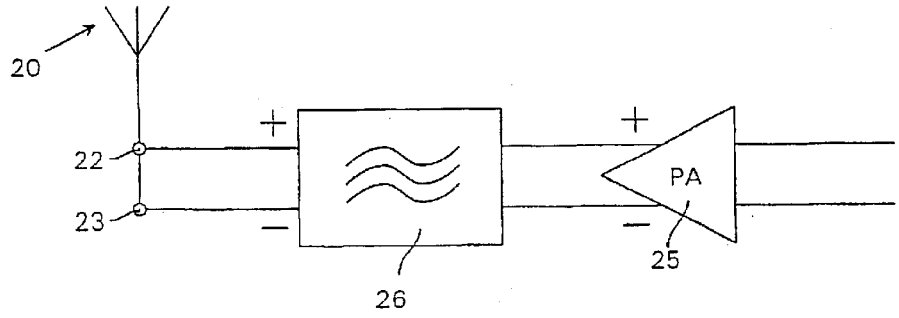
FIG. 8 is a block diagram showing a preferred layout of the transmitting RF chain of an antenna device according to the invention.

It will be realised that the receiver RF chain described with reference to FIG. 7 and the transmitter RF chain described with reference to FIG. 8 are applicable to the receiver and transmitter portions of all the above described embodiments.

What is claimed is:

1. An antenna device for a portable radio communication device, said antenna device comprising a first antenna element comprising a first feeding portion connected to a first feeding device, a second antenna element comprising second feeding portions connected to a second feeding device, wherein said first antenna element has an unbalanced feed and is positioned spaced apart from a ground plane and essentially parallel thereto, said second antenna element has an essentially balanced feed, and said second antenna element is a loop antenna.

2. The antenna device according to claim 1, wherein said first antenna element is adapted for transmitting radio signals and said second antenna element is adapted for receiving radio signals.

3. The antenna device according to claim 1, wherein both said first and said second antenna element are adapted for transmitting radio signals.

4. The antenna device according to claim 1, wherein both said first and said second antenna element are adapted for receiving and transmitting radio signals.

5. The antenna device according to claim 1, wherein both said first and said second antenna element is are adapted for receiving radio signals.

6. The antenna device according to claim 1, wherein said first antenna element is adapted for receiving radio signals and said second antenna element is adapted for transmitting radio signals.

7. The antenna device according to claim 1, wherein said first antenna element is adapted for receiving radio signals and said second antenna element is adapted for receiving and transmitting radio signals.

8. The antenna device according to claim 1, wherein said first antenna element is adapted for receiving and transmitting radio signals and said second antenna element is adapted for transmitting radio signals.

9. The antenna device according to claim 1, wherein said first antenna element is adapted for transmitting radio signals and said second antenna element is adapted for receiving and transmitting radio signals.

10. The antenna device according to claim 1, wherein said first antenna element is adapted for receiving and transmitting radio signals and said second antenna element is adapted for receiving radio signals.

11. The antenna device according to claim 1, wherein said first antenna element is selected from the group consisting of: PIFA, Patch, modified PIFA, meander PIFA, and slot.

12. The antenna device according to claim 1, wherein said second antenna element is positioned in a plane essentially parallel to said first antenna element.

13. The antenna device according to claim 1, wherein said second antenna element is positioned in a plane essentially perpendicular to said first antenna element.

14. The antenna device according to claim 1, wherein said second antenna element essentially surrounds said first antenna element.

15. The antenna device according to claim 1, wherein said second feeding device comprises a balanced filter, inputs of which are arranged to receive signals from said second feeding portions, and a balanced amplifier the inputs of which are arranged to receive signals from outputs of said balanced filter.

16. The antenna device according to claim 15, wherein said balanced amplifier is a low noise amplifier, preferably provided by ASIC technology.

17. The antenna device according to claim 1, wherein said first feeding device comprises a balanced amplifier, inputs of which are arranged to receive signals to be transmitted and an output of which is balanced, and a balanced filter, inputs of which are arranged to receive signals from said amplifier and outputs of which are arranged to transmit signals to said first antenna element.

18. A portable radio communication device comprising an antenna device, said antenna device comprising a first antenna element comprising a first feeding portion connected to a first feeding device, a second antenna element comprising second feeding portions connected to a second feeding device, wherein said first antenna element has an unbalanced feed and is positioned spaced apart from a ground plane and essentially parallel thereto, said second antenna element has an essentially balanced feed, and said second antenna element is a loop antenna.

* * * * *